US005765933A

United States Patent [19]

Paul et al.

[11] Patent Number: 5,765,933

[45] Date of Patent: Jun. 16, 1998

[54] CAM ASSISTED EJECTION HANDLE FOR A REMOVABLE DRIVE CARRIER

[75] Inventors: Dieter G. Paul, Anaheim; Jim D. Yu, Irvine, both of Calif.

[73] Assignee: Kingston Technology Company, Fountain Valley, Calif.

[21] Appl. No.: 799,917

[22] Filed: Feb. 13, 1997

[51] Int. Cl.[6] ..... A47B 95/02; H01R 13/62

[52] U.S. Cl. ..... 312/332.1; 312/223.1; 439/157; 361/685

[58] Field of Search ..... 312/332.1, 223.2, 312/330.1, 333, 334.23; 211/26; 361/685, 724, 725, 726, 727, 732, 740; 439/152, 155, 157, 325, 327, 328, 345

[56] References Cited

U.S. PATENT DOCUMENTS

| | | | |
|---|---|---|---|
| 2,944,864 | 7/1960 | Krivulka | 312/332.1 |
| 4,002,381 | 1/1977 | Wagner et al. | 312/332.1 X |
| 4,955,678 | 9/1990 | Kobayashi | 312/332.1 |
| 5,208,735 | 5/1993 | Twachtman et al. | 312/332.1 X |
| 5,222,897 | 6/1993 | Collins et al. | 439/157 |
| 5,269,698 | 12/1993 | Singer | 439/157 |
| 5,379,184 | 1/1995 | Barraza et al. | 312/332.1 X |
| 5,557,499 | 9/1996 | Reiter et al. | 361/725 X |
| 5,586,003 | 12/1996 | Schmitt et al. | 361/685 X |
| 5,588,728 | 12/1996 | Eldridge et al. | 312/332.1 X |

*Primary Examiner*—Peter M. Cuomo
*Assistant Examiner*—James O. Hansen
*Attorney, Agent, or Firm*—Morland C. Fischer

[57] ABSTRACT

A portable drive carrier for a memory device for use at a computer or workstation. The carrier has a rotatable handle that is adapted to assist in the detachment and ejection of the carrier from a U-shaped receiving frame that is commonly mounted at an existing drive bay of the computer workstation. The carrier includes a pair of handle cams that are coupled to respective sides of the carrier so as to move therealong in response to a rotation of the handle. The handle cams move into engagement with and apply a pushing force against the receiving frame, whereby the carrier is advanced relative to and detached from the receiving frame to enable the carrier to be pulled out of and removed from the frame. The handle cams are interfaced with force transmitting surfaces formed in the handle so that a rotation of the handle is transferred to the handle cams to cause the handle cams to move along the sides of the carrier in order to apply the pushing force against the receiving frame.

18 Claims, 5 Drawing Sheets

CAM ASSISTED EJECTION HANDLE FOR A REMOVABLE DRIVE CARRIER

BACKGROUND OF THE INVENTION

1. Field of the Invention

This invention relates to a rotatable handle that is attached to a portable drive carrier for a computer or workstation to assist in the detachment and ejection of the carrier from a U-shaped receiving frame that is commonly mounted at an existing drive bay of the computer or workstation.

2. Background Art

Portable carriers for a memory device (e.g. a hard drive) have been associated in the past with computers and workstations. For example, the data stored in the memory device may be sensitive or confidential. In this case, it would be desirable to remove the carrier at the end of the day for relocation to a secure area so as to deny access to the data by unauthorized persons. By way of further example, it may also be desirable to transport the carrier from a computer at one location to a remote location at which the carrier may be returned to a different computer.

In each of these examples, a handle of the carrier is usually grasped and pulled to exert sufficient force to remove the carrier from its receiving frame. Sometimes, the carrier is tightly connected to its receiving frame so that it is difficult to remove the carrier. As a consequence of the foregoing, excessive pulling forces may have to be applied to the carrier handle. In this regard, the ejection mechanism of the carrier or its receiving frame has been known to break with the result that it becomes difficult to return the carrier to its computer or workstation. Otherwise, to repair the ejection mechanism means that the carrier or the computer must be taken out of service which may prove to be an inefficient use of time and equipment.

Accordingly, it would be desirable to be able to facilitate the ejection and removal of the carrier from its receiving frame without requiring an excessive pulling force or the possibility that the ejection mechanism may break in response to the pulling force applied to the handle of the carrier.

SUMMARY OF THE INVENTION

Briefly, a rotatable ejection handle and a pair of handle cams cooperate with one another to enable a carrier for a memory device (e.g. a hard drive) to be quickly and easily ejected and removed from a U-shaped receiving frame of the kind that is commonly found at an existing drive bay of a computer or workstation. A handle cam is coupled to each side of the carrier and adapted to move relative thereto. Each handle cam includes a generally G-shaped body having a force receiving arm projecting outwardly from one end thereof and a stop bar running along the opposite end. At the forward end of each side of the carrier are bottom, middle and top guide tabs that are disposed in parallel alignment one above the other to enable a handle cam to slide reciprocally therealong. The lowermost guide tab has a stop projecting therefrom against which the handle cam is initially seated to limit the forward travel of the handle cam. The middle guide tab is received through a tab receiving channel in the body of the handle cam to ensure a smooth and continuous movement of the handle cam along each side of the carrier. A conventional normally relaxed coil spring extends between each of the handle cams and the sides of the carrier from respective axially aligned spring retaining pins.

The ejection handle has a pair of parallel aligned arms that are pivotally coupled to opposite sides of the carrier. A cammed force transmitting surface is formed under each arm of the ejection handle to convert a rotational force generated by the handle into a linear pushing force to be transferred to the handle cams.

Initially, the ejection handle is disposed vertically against the front of the carrier, and the handle cams are seated against the stops which project from the lowermost guide tabs. The force receiving arms of the handle cams initially lie against the cammed force receiving surfaces of the ejection handle. To eject and remove the carrier from its supporting frame, the ejection handle is rotated relative to the carrier through a 90 degree arc from the vertical position to a horizontal position. During this rotation of the ejection handle, the cammed force transmitting surfaces thereof are correspondingly rotated around the force receiving arms of the handle cams, whereby to apply a pushing force against the handle cams and thereby cause the coil springs to be compressed. Accordingly, the handle cams slide rearwardly along the guide tabs at each side of the carrier until the stop bars of the handle cams engage respective ribs that are molded into and project inwardly from opposite sides of the U-shaped receiving frame. As the stop bars push rearwardly against the ribs of the receiving frame, the carrier is urged forwardly and disconnected from its receiving frame. When the ejection handle completes its rotation from the vertical position to the horizontal position, the force transmitting surfaces of the handle rotate past and out of engagement with the force receiving arms of the handle cams, whereby the pushing force formerly applied to the handle cams is now terminated. At this point, the springs are able to expand in order to automatically cause the handle cams to slide forwardly along the guide tabs at the sides of the carrier so as to be once again seated against the stops which project from the lowermost guide tabs. With the ejection handle in the vertical position, the handle may be grasped and pulled to quickly and easily remove the carrier from its receiving frame.

When the carrier is returned and connected to the same or a different receiving frame, the ejection handle is rotated relative to the carrier through another 90 degree arc from the horizontal position to the vertical position. In this case, the arms of the ejection handle engage and push up on the force receiving arms of the handle cams, whereby the force receiving arms are rotated upwardly rather than pushed rearwardly as in the case when the handle is rotated from the vertical position to the horizontal position. Accordingly, the rotational force generated by the ejection handle is absorbed by the upwardly rotating force receiving arms so that the handle cams are not moved rearwardly along the sides of the carrier and the carrier remains connected to its receiving frame. The force receiving arms of the handle cams are once again positioned against the respective cammed force transmitting surfaces of the ejection handle so as to latch the ejection handle in the vertical position relative to the carrier while awaiting the next rotation of the handle.

DETAILED DESCRIPTION

Figure 1:
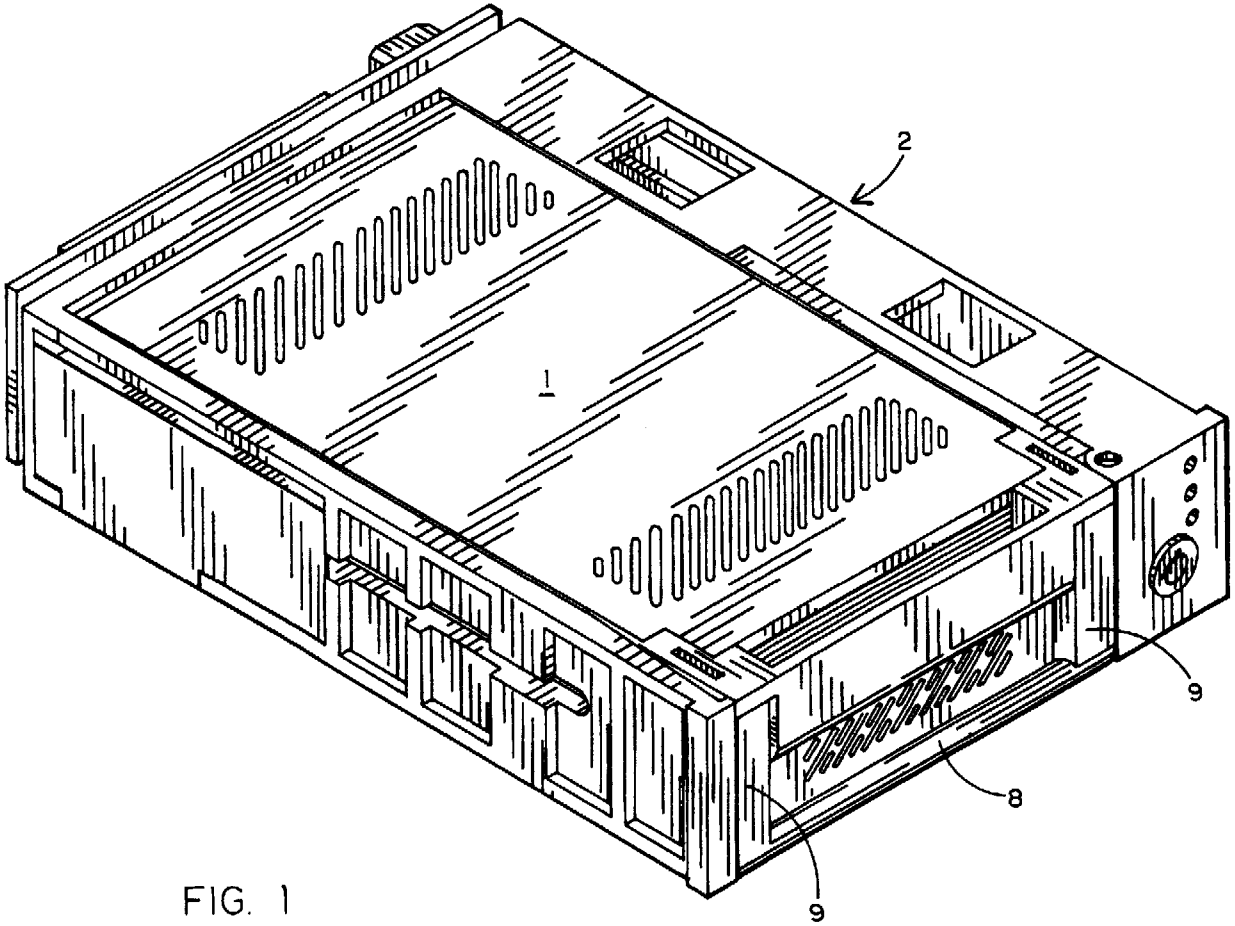
FIG. 1 is a perspective view showing a portable data carrier detachably connected to and retained within a U-shaped receiving frame.

Referring initially to FIG. 1 of the drawings, there is shown a carrier 1 for a portable computer storage unit. The carrier 1 is received within and surrounded by a generally U-shaped locking channel or receiving frame 2. The storage unit of carrier 1, in and of itself, is conventional and forms no part of the present invention. Briefly, however, the storage unit of carrier 1 is a memory device (e.g. a hard drive) that is commonly associated with a personal computer, a work station, or the like. The carrier 1 is adapted to be slidably and removably inserted within the U-shaped receiving frame 2. Receiving frame 2 is typically mounted at an existing drive receiving bay of the aforementioned personal computer, work station, etc. When the carrier 1 is located within its receiving frame 2, at least one male electrical connector (designated 4 in FIGS. 3–7) that projects outwardly from the rear of the carrier 1 is mated to a corresponding female electrical connector (designated 6 in FIGS. 3–7) that projects inwardly from the receiving frame 2, whereby the carrier 1 is both electrically and mechanically coupled to receiving frame 2. The receiving frame 2 is electrically connected to the computer (not shown) in which the receiving frame 2 is disposed by means of external connectors 7 that project outwardly from the rear of frame 2.

As will be explained in greater detail hereinafter, the carrier 1 has an ejection handle 8 that is pivotally coupled to the front of the carrier 1 by means of a pair of fasteners so that handle 8 is adapted to be rotated through an arc of 90 degrees between at rest and active positions. The ejection handle 8 has the usual pair of parallel aligned arms 9 and is used in the normal fashion to urge the carrier 1 into and out of its receiving frame 2 and to transport the carrier 1 when the computer storage unit thereof is to be moved to another computer or secured at a safe location. However, and as an additional and important advantage, the ejection handle 8 also automatically assists in detaching and separating the carrier 1 from its receiving frame 2.

To facilitate the aforementioned detachment of carrier 1, and as is shown in FIGS. 2–7, the carrier is provided with an elongated guide channel 10 running longitudinally and molded into each of the sides of the carrier 1. As is best shown in FIG. 8 of the drawings, the forward end of each guide channel 10 (i.e. the end lying immediately behind the ejection handle 8 at the front of carrier 1) terminates at a series of generally rectangular guide tabs 12, 14 and 16 that are arranged one above the other in spaced parallel alignment. The lowermost guide tab 12 has a finger or stop 18 projecting outwardly therefrom. A short spring retaining pin 20 extends forwardly from guide channel 10 between the lowermost and middle guide tabs 12 and 14. A longitudinally extending slot 22 is formed through the top of carrier 1 above and slightly outward from the location of the top most guide tab 16.

Figure 8:
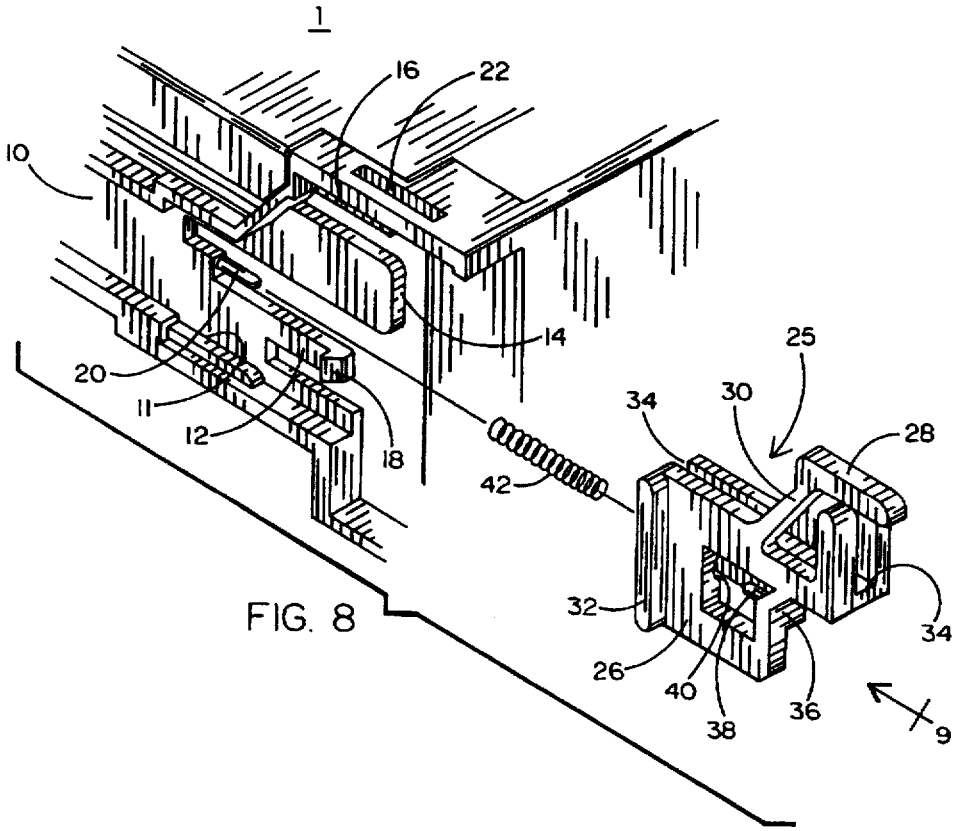
FIG. 8 is an exploded view showing a handle cam which also forms the present invention that is coupled to and adapted to slide along each side of the carrier in response to a rotation of the ejection handle.
Figure 9:
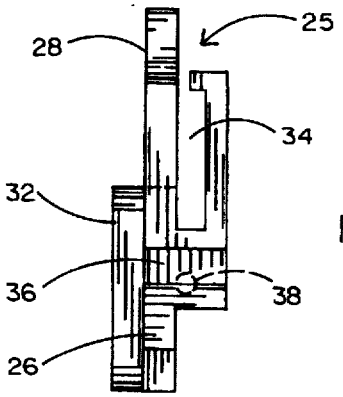
FIG. 9 is a front view of the handle cam of FIG. 8.

In accordance with the present improvement, a handle cam 25 is interfaced with the guide tabs 12, 14 and 16 at each side of the carrier 1 to convert a rotational movement of the ejection handle 8 into an axial (i.e. longitudinal) movement of the carrier 1 relative to its receiving frame 2. As is best shown in FIGS. 8 and 9, each of the handle cams 25 includes a generally G-shaped body 26 and a force receiving arm 28 which is held above and slightly ahead of body 26 by means of an integral joint 30. Handle cam 25 is preferably manufactured from a hard but flexible plastic material. Therefore, the integral joint 30 permits force receiving arm 28 to pivot upwardly and away from the body 26 in response to an upward pushing force applied to arm 28 by the ejection handle 8 (best shown in FIG. 7).

Located at the rear of each handle cam 25 and projecting outwardly along the back edge of the G-shaped body 26 thereof is a stop bar 32. A tab receiving channel 34 extends the entire length of handle cam 28 starting at the front and running across the top of body 26. The front of the G-shaped body 26 of handle cam 25 is closed upon itself by a short connecting piece 36. Projecting rearwardly from the connecting piece 36 is a second spring retaining pin 38. The spring retaining pin 38 is spaced ahead of and axially aligned with a spring receiving passage 40. The spring receiving passage 40 extends completely through the back of the body 26 of the handle cam 25.

In the assembled, at rest condition of FIG. 3, with the carrier 1 inserted inwardly of and attached to its receiving frame 2, each handle cam 25 of FIGS. 8 and 9 is coupled to the carrier 1 in a manner to be described as follows. The middle guide tab 14 projecting forwardly from the guide channel 10 at each side of the carrier 1 is received within the tab receiving channel 34 that extends entirely through the handle cam 25, whereby cam 25 is adapted to slide reciprocally along the middle guide tab 14. The force receiving arm 28 which is held above the body 26 of handle cam 25 by integral joint 30 is disposed flush against the topmost guide tab 16 in opposing face-to-face alignment therewith so as to be adapted to slide reciprocally over the topmost guide tab 16. It is important to note that in the at rest condition, the force receiving arm 28 extends sufficiently ahead of the topmost guide tab 16 to be in contact with a soon-to-be described cammed force transmitting surface 44 of the ejection handle 8. Therefore, a pushing force that is applied to the force receiving arm 28 when the handle 8 is rotated out of its at rest condition of FIG. 3 will be transferred via the integral joint 30 to the body 26 of handle cam 25 to cause the force receiving arm 28 to slide rearwardly along the topmost guide tab 16 and the body 26 to ride over the middle guide tab 14.

In this same regard, the bottom of the G-shaped body 26 of handle cam 25 rests upon the short ledge 11 of guide channel 10 so as to be disposed flush against the lowermost guide tab 12 in opposing face-to-face alignment therewith in order to ride reciprocally therealong. In the at rest position of the handle cam 25, the connecting piece 36 of handle cam 25 is seated against the stop 18 which projects from the lowermost guide tab 12 so as to limit the forward travel of handle cam 25 during its reciprocal movement along the guide tabs 12, 14, and 16.

With the handle cam 25 coupled to and adapted to ride along the guide tabs 12, 14, and 16 in the manner described above, a metallic coil spring 42 of conventional design extends via the spring receiving passage 40 of handle cam 25 between the spring retaining pin 20 which projects from the carrier 1 (between the lowermost and middle guide tabs 12 and 14) and the spring retaining pin 38 which projects from the connecting piece 36 of handle cam 25. The spring retaining pins 20 and 38 are disposed in spaced, opposing alignment so as to receive and support the forward and trailing ends of the coil spring 42.

In the at rest condition of the ejection handle 8, with the carrier 1 properly installed and connected within its receiving frame 2, the coil spring 42 is in an expanded, relaxed state. However, as will soon be described, when the ejection handle 8 is rotated to detach and remove carrier 1 from receiving frame 2, handle cam 25 will slide rearwardly along guide tabs 12, 14, and 16 for causing the spring 42 to undergo stress and be compressed so as to store energy. Once the ejection handle 8 has been fully rotated, the spring expands and releases its stored energy to automatically cause the handle cam 25 to slide forwardly along the guide tabs 12, 14, and 16 towards and into contact with the stop 18 which projects from the lowermost guide tab 12.

To this end, and as another important detail of the present invention, the ejection handle 8 is provided with a pair of cammed force transmitting surfaces 44 (best shown in FIGS. 3–7). More particularly, a cammed force transmitting surface 44 is formed below each of the arms 9 of handle 8 so as to initially lie in contact with the force receiving arms 28 of the handle cams 25 that are carried by and slidable along the guide tabs 12, 14, and 16 at opposite sides of carrier 1. As the ejection handle 8 is rotated from its at rest position (shown in FIGS. 1 and 3) to its active position (shown in FIGS. 5 and 6), the cammed force transmitting surfaces 44 correspondingly rotate around respective force transmitting arms 28 so that a rotational force generated by the ejection handle 8 will be transferred to each handle cam 25 to cause the handle cams 25 to slide linearly and rearwardly along the guide tabs 12, 14, and 16.

Figure 2:
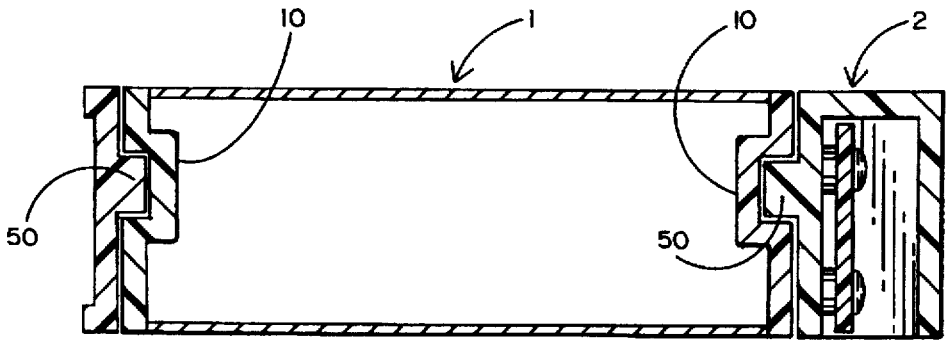
FIG. 2 is a cross-section illustrating the mating engagement of the carrier to its receiving frame.

To facilitate the removable receipt of the carrier 1 by its U-shaped receiving frame 2, a set of inwardly projecting ribs 50 are molded into the sides of the receiving frame 2 (best shown in FIG. 2). The ribs 50 (shown in phantom lines in FIGS. 3–5) are arranged in opposing alignment with one another and sized so as to be accommodated within and ride through respective guide channels 10 that are formed in opposite sides of the carrier 1. Therefore, as the carrier 1 moves relative to its receiving frame 2, the guide channels 10 of carrier 1 will slide along the ribs 50 of receiving frame 2 to insure a smooth and continuous displacement of the carrier 1 into and out of the frame 2.

The operation of the ejection handle 8 in combination with the pair of handle cams 25 to easily and reliably detach and eject the carrier 1 from its U-shaped receiving frame 2 is now disclosed. As best shown in FIG. 3, the ejection handle 8 and each handle cam 25 are initially at rest, and the carrier 1 is received within and mated to receiving frame 2 so that the male connector 4 at the rear of the carrier 1 is electrically connected to the female connector 6 of the frame 2. In the at rest position, the ejection handle 8 extends downwardly and vertically against the front of the carrier 1. Moreover, each handle cam 25 is disposed forwardly along the guide tabs 12, 14, and 16 so as to rest against the stop 18. The coil spring 42 which extends between the carrier 1 and each of the handle cams 25 (at the respective spring retaining pins 20 and 38 thereof) is expanded and relaxed.

Figure 3:
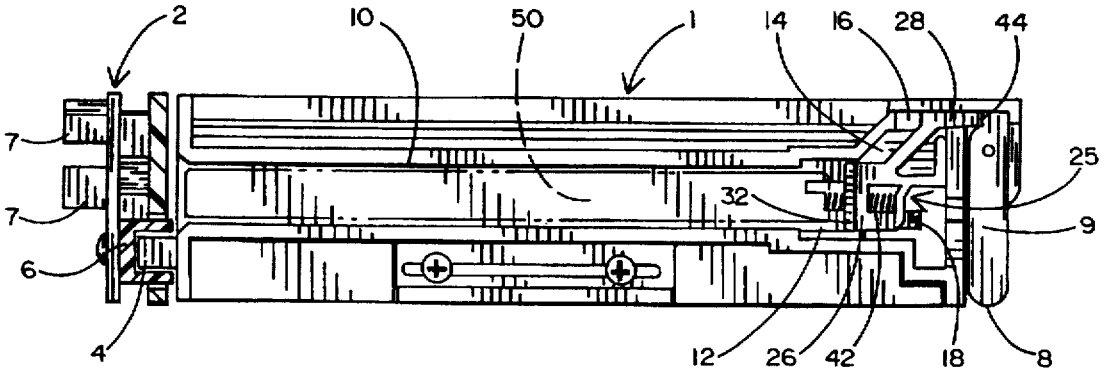
FIG. 3 shows a rotatable ejection handle of the carrier which forms the present invention in an at rest, vertical position with the carrier connected to and retained within its receiving frame.
Figure 4:
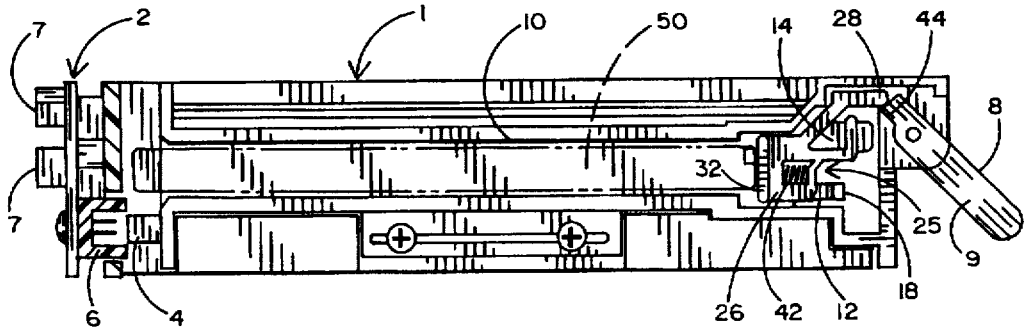
FIG. 4 and 5 show the rotatable ejection handle of the carrier being rotated to an active, horizontal position to cause the carrier to be ejected from its receiving frame.
Figure 5:
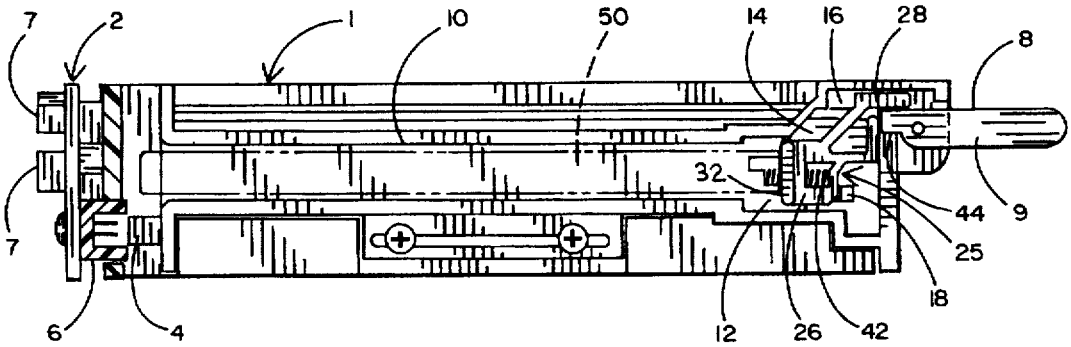

To detach and separate the carrier 1 from its receiving frame 2, the ejection handle 8 is rotated through an arc of 90 degrees from the downward, vertical position shown in FIG. 3 to an outward, horizontal position shown in FIG. 5. As the ejection handle 8 is rotated from the vertical position to the horizontal position, the rotational force is transferred from the cammed force transmitting surfaces 44 at the opposing arms 9 of handle 8 as a linear pushing force against the force receiving arms 28 of the handle cams 25 at the sides of the carrier 1 (best shown in FIG. 4) so as to cause each handle cam 25 to slide rearwardly relative to the carrier 1. That is to say, the force receiving arm 28 of each handle cam 25 slides against the uppermost guide tab 12, the body 26 of each handle cam 25 moves along the lowermost guide tab 12 and away from the stop 18, and the middle guide tab 14 is slidably received through the tab receiving channel 34.

As the handle cams 25 move rearwardly relative to carrier 1, the respective springs 42 thereof (the leading ends of which are coupled to cams 25) are compressed so as to store energy.

The stop bars 32 of the handle cams 25 are eventually pushed into engagement with the ribs 50 that project inwardly from opposing sides of the receiving frame 2. The stop bars 32 continue to move rearwardly with their handle cams 25 and push against the ribs 50 of receiving frame 2 until the carrier 1 is detached from its receiving frame 2 when the male connector 4 of carrier 1 is pulled out of the female connector 6 of frame 2. In other words, the rearward pushing force applied by the stop bars 32 against the ribs 50 results in an opposite forward movement or slight ejection of the carrier 1 relative to receiving frame 2.

Figure 6:
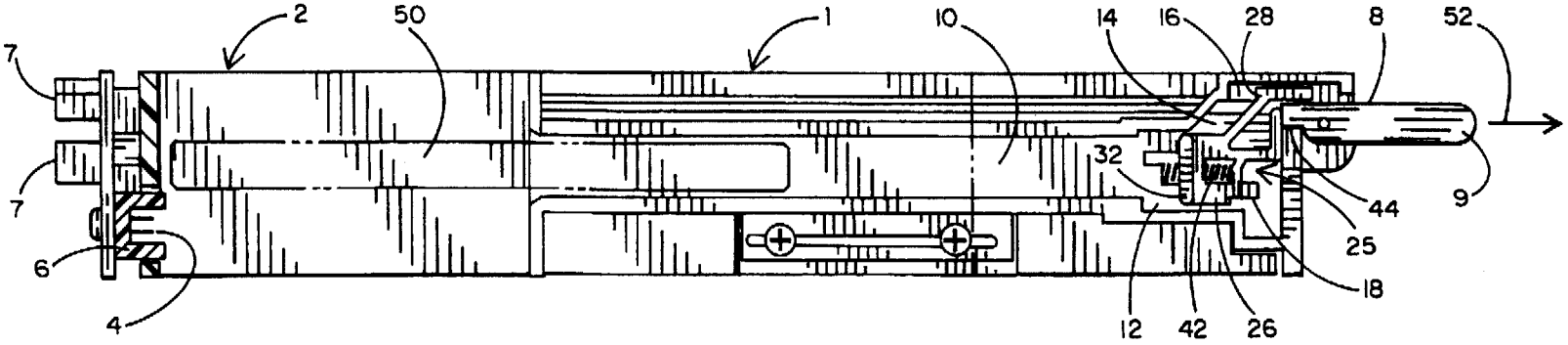
FIG. 6 shows the rotatable handle of the carrier in the horizontal position with the carrier being pulled outwardly and separated from its receiving frame.

By virtue of the foregoing, the carrier 1 is now advanced a short distance outwardly from its receiving frame 2 to enable carrier 1 to be easily separated from the receiving frame 2 after the ejection handle 8 is completely rotated to the horizontal position (shown at FIG. 5) at which position the handle 8 may be grasped and pulled (in the direction of the reference arrow 52 of FIG. 6) to remove carrier 1. As best shown in FIG. 6, as the carrier 1 is removed from its U-shaped receiving frame 2, the guide channels 10 at the sides of carrier 1 slide over and past the respective inwardly projecting ribs 50 of receiving frame 2.

In this regard, when the ejection handle 8 has completed its full 90 degree rotation from the at rest, vertical position of FIG. 3 to the active, horizontal position of FIGS. 5 and 6, the force transmitting surfaces 44 at the arms 9 of ejection handle 8 are correspondingly rotated past and out of engagement with the force receiving arms 28 of the handle cams 25. Thus, the pushing force formerly applied by the force transmitting surfaces 44 to force receiving arms 28 is terminated which enables the springs 42 to release their stored energy and expand towards their at rest condition prior to the rotation of ejection handle 8. Accordingly, the expanding springs 42 (the trailing ends of which are coupled to carrier 1) urge the handle cams 25 to automatically move forwardly relative to the carrier 1 so as to slide along the guide tabs 12, 14, and 16 towards their original at rest position with the bodies 26 of handle cams 25 once again seated against the stops 18 which project from the lowermost guide tabs 12.

Figure 7:
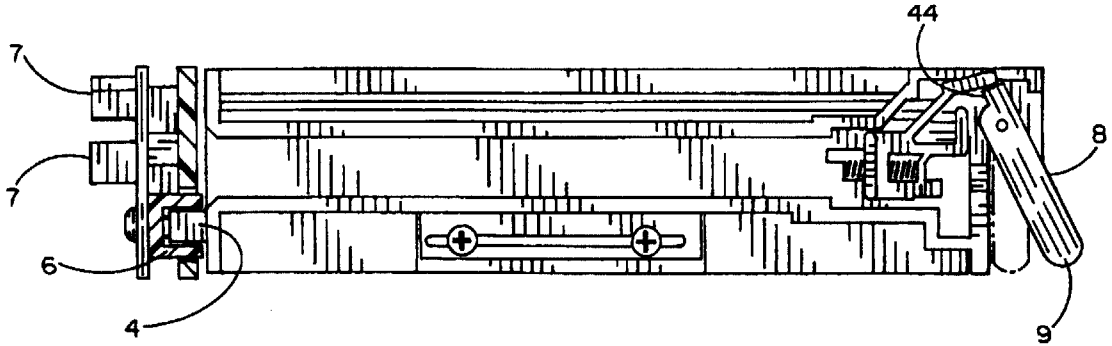
FIG. 7 shows the carrier returned to its receiving frame with the ejection handle of the carrier being rotated from the active, horizontal position to the at rest, vertical position.

FIG. 7 of the drawings shows the carrier 1 after it has been returned to the same or a different U-shaped receiving frame 2. After carrier 1 is installed in its receiving frame 2, with the electrical connectors 4 and 6 pushed together so that carrier 1 is once again electrically and mechanically coupled to frame 2, the ejection handle 8 is rotated through another arc of 90 degrees from the active, horizontal position, at which handle 8 can be grasped to enable carrier 1 to be pushed inwardly of receiving frame 2, to the at rest, vertical position (shown in phantom lines in FIG. 7).

During a rotation of the ejection handle from the horizontal position to the vertical position, the tops of the arms 9 of ejection handle 8 (opposite the location of cammed force transmitting surfaces 44) engage and push up on the force receiving arms 28 of the handle cams 25. Hence, the force receiving arms 28 are rotated upwardly and into the slots (designated 22 and best shown in FIG. 8) that extend through the top of carrier 1. In this case, it may be appreciated that the rotational force generated by the ejection handle 8 will not be transferred to the handle cams 25 but is otherwise substantially dissipated when the force receiving arms 28 of each handle cams 25 are rotated upwardly into the slots 22. Therefore, and unlike the case when the ejection handle 8 is rotated from the at rest, vertical position to the active, horizontal position to detach the carrier 1 from receiving frame 2, virtually none of the rotational force generated by handle 8 is transferred to the handle cams 25, whereby the handle cams 25 are not displaced relative to carrier 1. Since no axial pushing force is applied from the ejection handle 8 to the handle cams 25, the carrier 1 will remain securely attached to its receiving frame to be used in the normal fashion with a personal computer, workstation, or the like. What is more, when the ejection handle is restored to its at rest, vertical position, the force receiving arms 28 of the handle cams 25 will be once again positioned against the respective cammed force transmitting surfaces 44 of the ejection handle 8 so as to hold and latch the handle 8 in the vertical position against the carrier 1 to await the next rotation of the handle.

It will be understood that while a preferred embodiment of this invention has been shown and described, various changes may be made without departing from the true spirit and scope thereof. Having thus set forth the preferred embodiment,

What is claimed is:

1. In combination:

A portable carrier for a memory device, said carrier to be removably received in and attached to a receiving frame that is located at a drive bay of a computer or workstation, said carrier having a pair of sides, a front, and a handle pivotally attached to the front of the carrier and rotatable relative thereto so that the carrier can be pulled out of the receiving frame and transported from one place to another;

force transmitting means coupled to said carrier and cooperating with said handle so as to be adapted to convert a rotation of said handle into a pushing force against the receiving frame whereby said carrier is advanced relative to and detached from the receiving frame to permit said carrier to be pulled out and removed from the receiving frame; and a cammed surface formed on said handle and engaging said force transmitting means so as to rotate with said handle and cause said force transmitting means to move in a first direction relative to said carrier for applying said pushing force against the receiving frame.

2. The combination recited in claim 1, wherein said force transmitting means is coupled to said carrier so as to move in said first direction along at least one of the pair of sides thereof in response to a rotation of said handle.

3. The combination recited in claim 2, wherein said force transmitting means has a force receiving arm located at one end thereof to communicate with said cammed surface of said handle and a blocking head located at the opposite end of said force transmitting means to move into contact with and apply said pushing force against the receiving frame when said force transmitting means moves in said first direction along said at lest one side of said carrier in response to a rotation of said handle.

4. The combination recited in claim 2, wherein said carrier has a guide tab located at said at least one side thereof, said force transmitting means riding over said guide tab when said force transmitting means moves in said first direction along said at least one side of said carrier in response to a rotation of said handle.

5. The combination recited in claim 2, also including spring means extending between said force transmitting means and said at least one side of said carrier, said spring means being compressed when said force transmitting means moves in said first direction along said at least one side of said carrier in response to a rotation of said handle, and said spring means expanding to cause said force transmitting means to move in an opposite direction along said at least one side of said carrier when said handle has completed its rotation.

6. The combination recited in claim 5, including stop means projecting outwardly from said at least one side of said carrier to engage said force transmitting means and limit the travel of said force transmitting means in said opposite direction.

7. A portable carrier for a memory device, sad carrier to be removably received in and attached to a receiving frame that is located at a drive bay of a computer or workstation, said carrier having a pair of sides, a front, and a handle pivotally attached to the front of said carrier and rotatable between first and second positions so that said carrier can be pulled out of the receiving frame and transported from one place to another, said carrier also having a coupler adapted to exert a pushing force against the receiving frame in response to a rotation of said handle from said first position to said second position whereby said carrier is advanced relative to and detached from the receiving frame to permit said carrier to be pulled out of and removed from the receiving frame, and said handle having a cammed surface that engages said coupler when said handle is rotated from said first position to said second position to cause said coupler to move in a first direction relative to said carrier for exerting said pushing force against the receiving frame.

8. The portable carrier recited in claim 7, wherein said coupler is attached to at least one of said pair of sides of said carrier for reciprocal movement therealong, said coupler moving in said first direction for causing said pushing force to be exerted against the receiving frame when said handle is rotated from said first position to said second position.

9. The portable carrier recited in claim 8, wherein said carrier also has a spring extending between said coupler and said at least one side of said carrier, said spring being compressed when said coupler moves in said first direction along said at least one side of said carrier as said handle is rotated from said first position to said second position, and said spring expanding to cause said coupler to move in an opposite direction along said at least one side of said carrier when said handle has completed its rotation and is located at said second position.

10. The portable carrier recited in claim 9, wherein said carrier also has a guide tab located at said at least one side thereof, said coupler riding over said guide tab when said coupler moves in each of said first and opposite directions along said at least one side of said carrier.

11. The portable carrier recited in claim 7, wherein said coupler includes a coupler body and a force receiving arm projecting from said coupler body and communicating with said cammed surface of said handle, said cammed surface riding over said force receiving arm for causing said coupler to move in said first direction relative to said carrier when said handle is rotated from said first position to said second position.

12. The portable carrier recited in claim 11, wherein said coupler also includes a blocking head connected to said coupler body so as to be moved towards and into contact with the receiving frame to exert said pushing force thereagainst when said handle is rotated from said first position to said second position and said coupler moves in said first direction.

13. The portable carrier recited in claim 11, wherein said coupler is manufactured from a flexible material such that said force receiving arm projecting from said coupler body is bent when said handle is rotated from said second position to said first position to thereby absorb a rotational force applied to said coupler from said handle so that said coupler body remains substantially stationary relative to said at least one side of said carrier.

14. A portable carrier for a memory device, said carrier to be removably received in and attached to a receiving frame that is located at a drive bay of a computer or workstation, said carrier having a handle pivotally attached thereto and rotatable between a first position and a second position so that said carrier can be pulled out of the receiving frame and transported from one place to another, said carrier also having a coupler moving in a first direction relative to said carrier for exerting a pushing force against the receiving frame in response to a rotation of said handle from said first position to said second position, whereby said carrier is advanced relative to and detached from the receiving frame to permit said carrier to be pulled out of and removed from the receiving frame, said coupler including a flexible force receiving arm that is engaged by said handle so that said coupler is moved in said first direction for exerting said pushing force against the receiving frame when said handle is rotated from said first position to said second position, said flexible force receiving arm being engaged by said handle and bending when said handle is rotated from said second position to said first position to thereby absorb a rotational force applied by said handle to said flexible force receiving arm so that said coupler remains substantially stationary relative to said carrier.

15. The portable carrier recited in claim 14, wherein said handle has at least one cammed surface engaging the flexible force receiving arm of said coupler to cause said coupler to move in said first direction when said handle is rotated from said first position to said second position.

16. The portable carrier in claim 14, wherein said coupler also includes a blocking head connected to said coupler opposite said flexible force receiving arm and moved towards and into contact with the receiving frame to exert said pushing force thereagainst when said handle is rotated from said first position to said second position and said coupler moves in said first direction.

17. The portable carrier recited in claim 14, wherein said carrier also has a spring carried by said coupler, said spring being compressed when said coupler moves in said first direction relative to said carrier as said handle is rotated from said first position to said second position, and said spring expanding to cause said coupler to move in an opposite direction relative to said carrier after said handle has been rotated to said second position.

18. The portable carrier recited in claim 17, wherein said carrier also has a pair of opposite sides and a guide tab located at one of said sides, said coupler riding over and along said guide tab when said coupler moves in said first and opposite directions.

* * * * *